US008692449B2

(12) United States Patent
Jackson

(10) Patent No.: US 8,692,449 B2
(45) Date of Patent: Apr. 8, 2014

(54) FAUX FILAMENT LIGHTING DEVICE

(76) Inventor: Nicholas Jackson, Carol Stream, IL (US)

( * ) Notice: Subject to any disclaimer, the term of this patent is extended or adjusted under 35 U.S.C. 154(b) by 190 days.

(21) Appl. No.: 13/358,650

(22) Filed: Jan. 26, 2012

(65) Prior Publication Data

US 2013/0194797 A1 Aug. 1, 2013

(51) Int. Cl.
*F21V 1/00* (2006.01)
*F21V 5/04* (2006.01)

(52) U.S. Cl.
USPC ..... 313/236; 362/238; 362/240; 362/249.02; 362/311.02; 362/311.06; 362/355; 362/217.02; 362/800

(58) Field of Classification Search
None
See application file for complete search history.

(56) References Cited

U.S. PATENT DOCUMENTS

| | | | | |
|---|---|---|---|---|
| 2005/0180133 | A1* | 8/2005 | Feldstein | 362/219 |
| 2009/0002986 | A1* | 1/2009 | Medendorp et al. | 362/247 |
| 2010/0149814 | A1* | 6/2010 | Zhai et al. | 362/293 |
| 2011/0157896 | A1* | 6/2011 | Yu | 362/293 |
| 2013/0094179 | A1* | 4/2013 | Dai et al. | 362/84 |

* cited by examiner

*Primary Examiner* — Ashok Patel

(57) ABSTRACT

LEDs are considered to be point light sources. Visible light provided by one or more light emitting diodes (LEDs) is passed through a light diffuser. The LEDs and diffuser are mounted inside a transparent or light-transmissive non-evacuated envelope and bulb. The light emitted from the bulb appears to originate from a filament used in conventional light bulbs rather than from a point light source.

10 Claims, 3 Drawing Sheets

FAUX FILAMENT LIGHTING DEVICE

FIELD OF THE INVENTION

The present invention relates to an artificially simulated incandescent filament suited for replicating the appearance of vintage carbon filament light bulbs.

BACKGROUND OF THE INVENTION

Conventional incandescent light bulbs heat a filament inside a glass bulb, which is at least partially evacuated. Such bulbs are able to create what is considered by many to be a soft amber glow, which is also considered by many to be suitable for mood lighting and visually appealing. Such characteristics are those of a glowing filament contained inside the glass bulb.

Conventional incandescent bulbs are used in both interior and exterior garden and patio lighting applications where their visible lighting characteristics are desired. As is well known, conventional incandescent bulbs waste a substantial portion of the electrical energy required to operate. They are also relatively expensive to manufacture. A need is thus considered to exist for a reduced-energy-consumption lighting device that can provide the visual lighting effects of prior art incandescent light bulbs and which is relatively inexpensive to manufacture.

SUMMARY OF THE INVENTION

Light-emitting diodes or "LEDs" and diffusers simulate the effect of conventional incandescent light bulbs. More particularly, a hollow bulb, which is at least partially light transmissive, houses one or more LEDs and one or more diffusers that appear to be suspended in the interior of the bulb volume while diffusing the point light source from the LEDs in order to simulate extended lengths of light such that an incandescent filament provides.

DETAILED DESCRIPTION OF THE PREFERRED EMBODIMENTS

Figure 1:
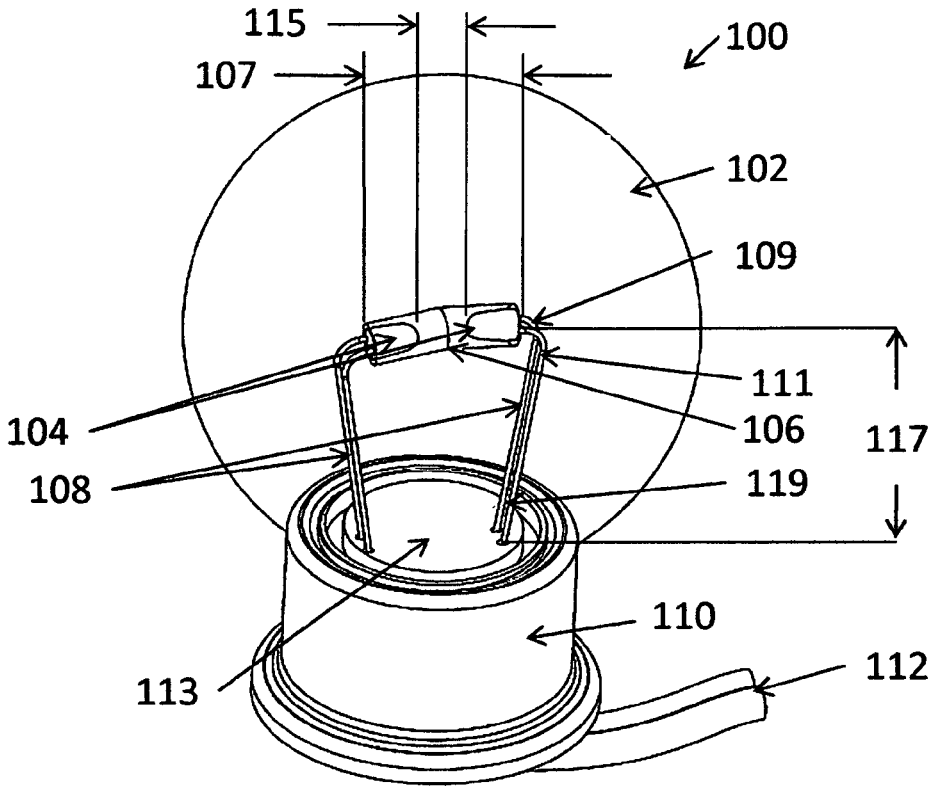
FIG. 1 is a perspective view of a faux filament light bulb assembly.

FIG. 1 is a perspective view of a faux filament light bulb assembly 100. The faux filament assembly 100 is comprised of a light-transmissive bulb 102, which is operatively coupled to a base 110, also referred to herein as a secondary housing 110. The bulb 102 encloses one or more light emitting diodes (LEDs) 104. Light emitted from the LEDs passes through diffusers 106. The light diffusers 106 are light diffusive.

The housing 110 contains electrical devices that connect terminals or leads 108 of LEDs to wires 112, which are in turn connected to an electrical power source, not shown. The LEDs support, or are placed into, one or more light diffusers 106, which cover or encapsulate at least part of the LED's light-emitting surfaces. In some embodiments, the base 110 contains circuitry to convert common A.C. voltage to D.C. voltage for the LEDs. Such circuitry is well known to those of ordinary skill. Description of such circuitry is therefore omitted for brevity. In some embodiments, the base 110 contains electronic components, such as circuit boards and resistors, in order to supply the appropriate electricity for the LEDs. Such circuitry is well known to those of ordinary skill. Description of such circuitry is therefore omitted for brevity.

The point light source of the LEDs 104 is transmitted into a diffuser 106 and thereafter diffused along the length 107 of the diffuser 106. The light from the LED that is diffused simulates or approximates the diffuse lighting effect provided by a conventional incandescent bulb/filament.

The leads 108 are actually comprised of a positive lead 109 and a negative lead 111. One of them is also considered herein to be an anode lead while the other is considered herein to be a cathode lead. As shown in FIG. 1, the leads 108 support the LEDs 104 above the top surface 113 of the housing 110 by a distance 117 substantially equal to the length of the leads 108. Elevating the LEDs 104 and their associated diffusers 106 above the top surface 113 aids the simulation of a conventional bulb but it also facilitates the broadcast of light energy from the LEDs 104. In an alternate embodiment not shown, wherein the orientation of the housing 110 and bulb 102 are "reversed" in order to have the bulb assembly 100 suspended from a ceiling from the housing 110, the leads 108 suspend the LEDs 104.

The LEDs 104 are spatially separated from each other in the bulb 102, the distance 115 between them being a design choice selected to provide among other things, different simulated filament lengths to visibly balance different bulb 102 shapes. Spatial separation of the LEDs can be accomplished and adjusted by bending the leads 108, the distal ends 119 are rigidly fixed in the housing 110.

As stated above, the bulb 102 is light transmissive. As used herein, the term "transmissive" should be construed to mean that at least some of the visible light emitted from the LEDs 104 is able to pass through the bulb housing.

The term "diffuse" is considered herein to mean, not concentrated or not localized. "Diffusive" should therefore be construed to mean tending to diffuse. Since "diffuse" means not concentrated or not localized, diffusive light, i.e., light from the LEDs 104 that is diffused by the diffuser 106, should be construed to include light that does not appear to come from a point source but instead appears to come from a somewhat "spread-out" source, or a non-localized, or not concentrated source. Light from the LEDs 104 that is diffused will thus appear to make the diffuser 106 as if it is entirely illuminated, and from inside the diffuser 106, and not from a localized point as does the light from a non-diffused LED.

Figure 2:
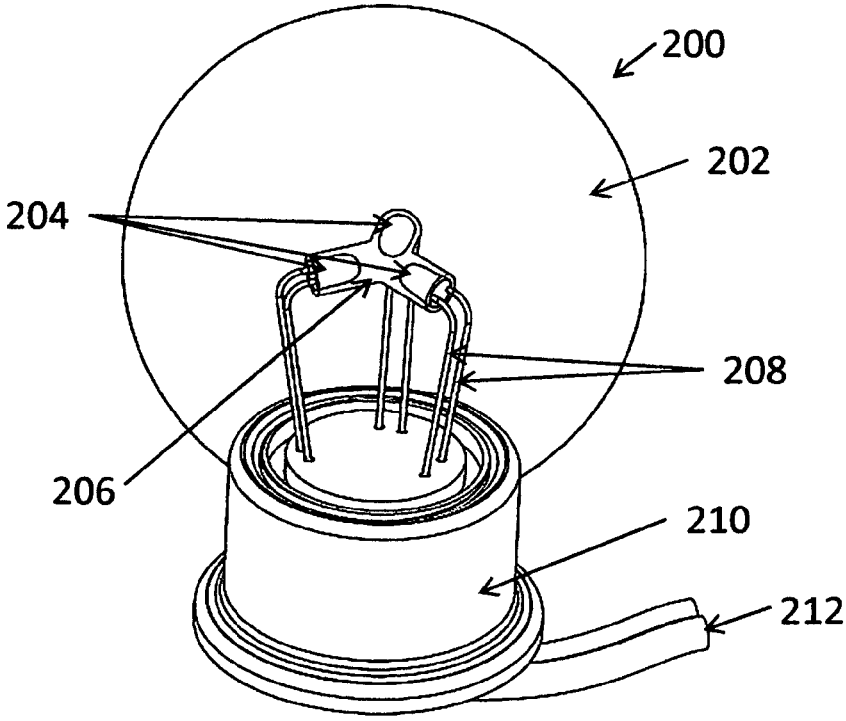
FIGS. 2-4 depict alternate embodiments of a faux filament light bulb assembly.

FIG. 2 is a perspective view of an alternate embodiment of the faux filament light bulb assembly 200. The assembly 200 is comprised of a light transmissive bulb housing 202 that encloses three LEDs 204, each of which is at least partially enveloped or encapsulated in a light diffuser 206. The lead wires 208 of the LEDs 204 are operatively coupled to a secondary housing 210. The housing 210 contains and provides electrical connections between the lead wires 208 of the LEDs 204 and wires 212 that can be connected to an electrical energy source not shown.

As with the faux filament bulb 100 shown in FIG. 1, the housing 210 shown in FIG. 2 provides a base to which the LEDs 204 can be mounted. Since the diffuser 206 is attached to the LEDs 204, the housing 210 also supports the diffuser 206. The point light source from the LEDs 204 is transmitted and diffused throughout the diffuser 206 in order to provide substantially uniform light in order to simulate the light effect of an incandescent filament. The positive and negative leads 208, also known as the anode and cathode, are used to suspend the LEDs 204 in the interior bulb volume in order to give a separation distance for the light source from the secondary housing 210 which is common for incandescent type light bulbs. Note that the LED leads 208 described can also be an alternate substantially rigid conductive component used to transmit electricity to the LEDs 204.

Figure 3:
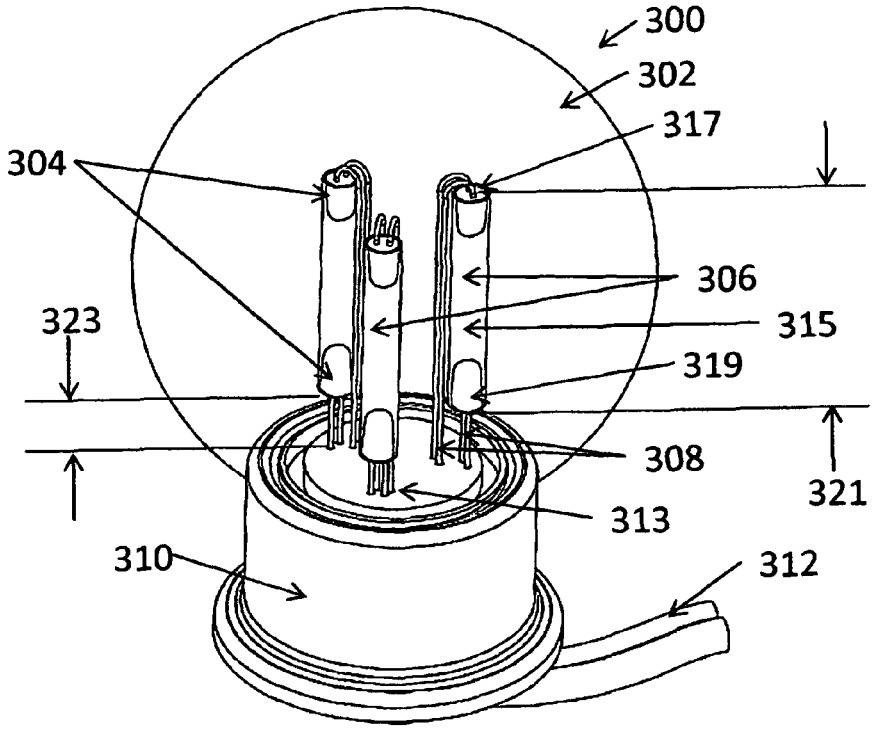

FIG. 3 is a perspective view of an alternate embodiment of a faux filament light bulb assembly 300. In FIG. 3, the assembly 300 is comprised of a light transmissive bulb housing 302, operatively coupled to a base or secondary housing 310, which contains the electrical connections and mounting structure 313 to hold or mount the LEDs 304, which support diffusers 306. In FIG. 3, the diffusers 306 are elongated, light-transmissive cylinders 315 having two opposing ends 317 and 319 into which LEDs 304 are inserted and which frictionally-engage the interior surface of the cylinder 315. The point light source from the LEDs 304 is transmitted through-out the length 321 of the cylinder 315 and diffused throughout the diffusers 306 to provide substantially uniform light, which approximates or simulates the light effect of an incandescent filament. The leads 308 of each diode 304 support the LEDs 304 above the housing 310 and from other diodes 304 to provide a separation distance 323 for the light source from the secondary housing 310.

Figure 4:
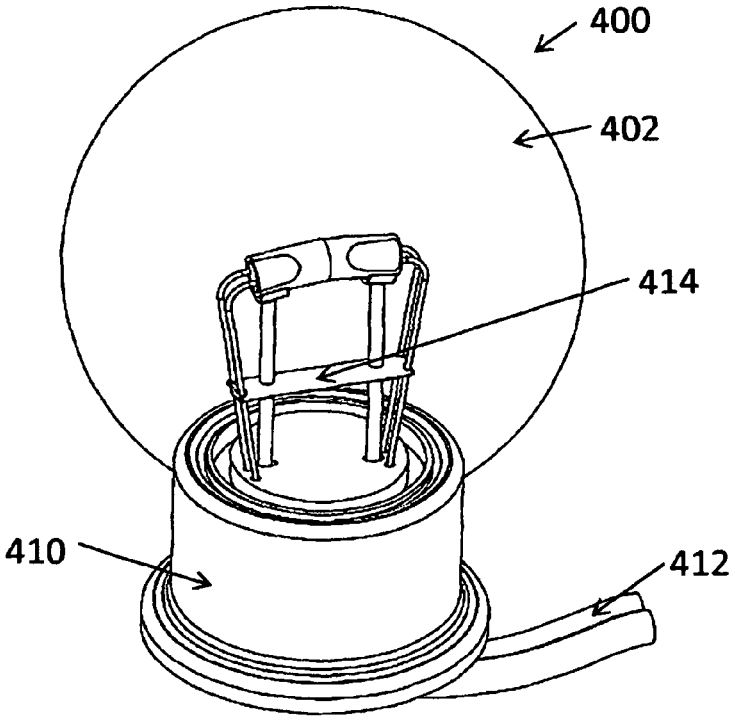

FIG. 4 is a perspective view of an alternate embodiment of a faux filament bulb assembly 400. In FIG. 4, the assembly 400 is comprised of a light transmissive bulb housing 402, operatively coupled to a base or secondary housing 410, which contains the electrical connections. In this embodiment, a substantially rigid secondary component 414 is used to support at least a portion of the mass of the LEDs 404 and diffuser 406. The secondary support structure 414 reduces or eliminates the need for the LED leads 408 to support the LEDs 404 and diffuser 406.

Figure 5:
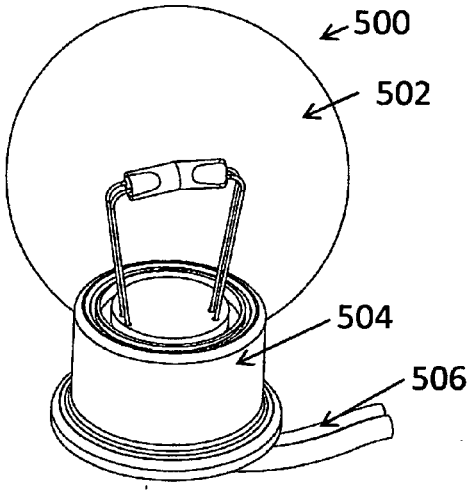
FIG. 5 is a perspective view of an installation application of the faux filament light bulb assembly.
Figure 6:
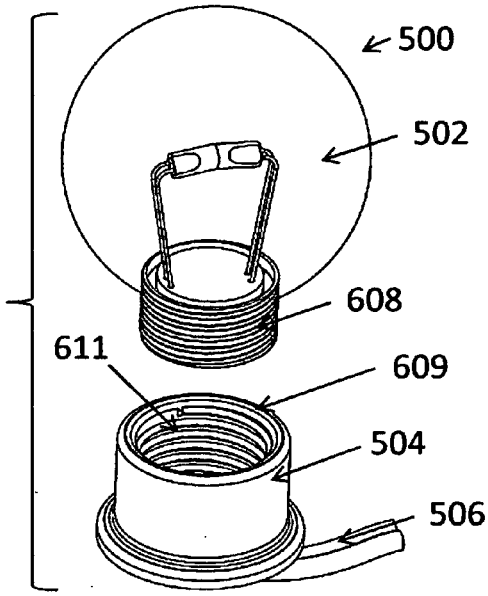
FIG. 6 is an exploded view of the installation application shown in FIG. 5.

FIGS. 5 and 6 depict a faux filament light bulb installation assembly 500 comprising of a faux filament light bulb assembly 502 and a receptacle assembly 504. In FIG. 6, the faux filament light bulb 502 is provided with a standard screw-type base 608. The base 608 includes an A.C. to D.C. converter, filter and current limiting resistors to enable the bulb assembly 500 to be energized by conventional A.C. voltages used to energize conventional light bulbs. The receptacle assembly 504 is provided with a socket 609 with conventional threads 611 that receive a standard screw-type base 608. Conventional electrical connections on the base 608 and in the socket 609 enable the bulb assembly to be used in a standard home light bulb socket. In an alternate embodiment, the receptacle assembly is provided with an A.C. to D.C. converter, filter and current limiting resistors to enable the bulb assembly 500 to be energized by conventional A.C. voltages used to energize conventional light bulbs.

Figure 7:
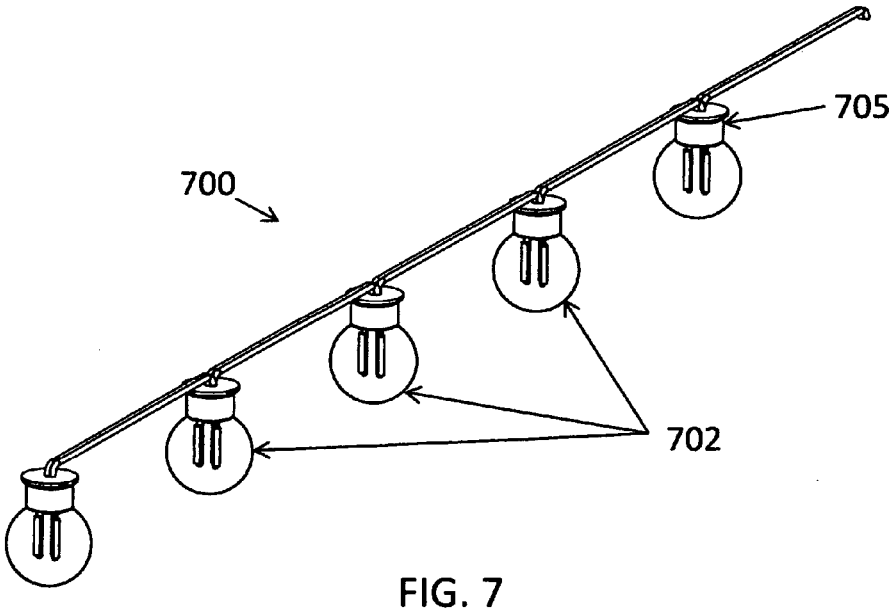
FIG. 7 is a perspective view of a light string assembly comprising of the faux filament light bulbs.

FIG. 7 is a perspective view of a light string assembly 700 comprising of a plurality of faux filament light bulbs 702 connected in series to either an A.C. or D.C. power source, not shown. In instances where the bulbs 702 are powered by A.C., an A.C. to D.C. converter is provided in at least one of the bulbs 702 or the receptacles 705 into which each bulb is attached.

The diffusers are preferably embodied as a substantially optically clear material, such as acrylic, wherein the exterior surface where light is diffused is textured to allow even distribution of light along their lengths. Faceted surfaces as well as openings along the length of the diffuser can also be employed to provide different effects. As depicted in the figures, the diffusers having openings 317 and 319 into which the substantially cylindrical lens body of an LED is inserted and frictionally engaged. The diffusers can also be directly molded to the LEDs or the LEDs can be custom made with the diffusers serving as the lens body of the actual LED at manufacture.

The bulb housing is preferably made from glass or plastic, but any substantially light transmissive material can be used for manufacture. The bulb housing can also be of any shape, but the scope of the invention implies that the bulb housing will resemble that of an incandescent light bulb which are typically a classic bulb shape or cylindrical in design. Unlike conventional incandescent bulbs, the bulb housing described above does not require any evacuation. The faux filament bulbs are thus considerably less expensive to manufacture The bulb housing is preferably substantially clear to simulate the effect of a vintage type carbon filament light bulb, but use of a textured or frosted bulb in combination with the LEDs and diffusers described above can be employed as long as a partial effect of the extended lengths of light created by the LEDs and diffusers is visible.

The use of a transparent holographic film applied to the bulb housing can also be employed in order to further extend the diffused lengths of light on the exterior surface of the bulb housing. Transparent holographic films contain embedded patterns which allow for the distortion of light passing through the material to create visual effects on the material. An application of this type of material directly to the bulb housing would allow the aforementioned visual effects to accentuate the visual effects created by the LEDs and diffusers.

Assembly of any of the aforementioned components can be accomplished by numerous methods employing integrated mechanical features or by use of adhesives, solder, potting processes, etc. It is assumed that housings are snapped together and other components are captured by integrated features while electrical connections are made by standard connectors and solder.

The foregoing description if for purposes of illustration. The true scope of the invention is set forth in the following claims.

What is claimed is:

1. A light bulb comprising:

a hollow, at least partially light transmissive light bulb housing;

a plurality of light-emitting diodes (LEDs) inside the light bulb housing, and comprising at least first and second light emitting diodes at least substantially facing each other; and at least one light pipe diffuser enclosing, and operatively coupled to, the at least first and second light emitting diodes, wherein light emitted from the first and second light emitting diodes is distributed from the diffuser and transmitted through an exterior surface of the light bulb housing.

2. A light bulb comprising:

a hollow, at least partially light transmissive light bulb housing;

a plurality of light-emitting diodes (LEDs) inside the light bulb housing, and comprising first, second and third light emitting diodes facing each other; and a light pipe diffuser comprising three prongs with a common center point, the three prongs spread apart substantially equally, and each prong enclosing, and operatively coupled to, the at least first, second and third light emitting diodes, the first, second and third light emitting diodes each facing the center point, wherein light emitted from the first, second and third light emitting diodes is distributed from the diffuser and transmitted through an exterior surface of the light bulb housing.

3. The light bulb of claim 1 or 2, wherein each of the plurality of light emitting diodes includes a lens body, and wherein the diffuser is molded to the lens body.

4. The light bulb of claim 1 or 2, wherein each of the light emitting diodes includes a lens body, and wherein a diffuser is formed as part of the LED lens body.

5. The light bulb of claim 1 or 2, wherein the plurality of light emitting diodes and the at least one diffuser are suspended inside the light bulb housing by leads that extend away from the at least one light emitting diodes, the leads being configured to be light emitting diode support structures.

6. The light bulb of claim 1 or 2, wherein the plurality of light emitting diodes and the at least one diffuser are suspended inside the light bulb by a substantially rigid conductive material as a support structure.

7. The light bulb of claim 1 or 2, wherein the plurality of light emitting diodes and the at least one diffuser are suspended inside the light bulb volume by a secondary support structure.

8. The light bulb of claim 1 or 2, wherein the light bulb housing comprises a holographic film which is configured to spread light further into extended lengths or patterns.

9. The light bulb of claim 1 or 2 further comprises a base including circuitry to convert A.C. voltage to D.C. voltage.

10. The light bulb of claim 1 or 2, wherein the base comprises threads which are configured to be received into a bulb socket having corresponding threads.

* * * * *